US010258097B2

(12) United States Patent
Popejoy

(10) Patent No.: US 10,258,097 B2
(45) **Date of Patent: *Apr. 16, 2019**

(54) PROTECTIVE HEADGEAR AND SHOULDER PAD APPARATUS AND METHODS

(71) Applicant: William Popejoy, Newport Beach, CA (US)

(72) Inventor: William Popejoy, Newport Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/031,451

(22) Filed: Jul. 10, 2018

(65) Prior Publication Data

US 2018/0360153 A1 Dec. 20, 2018

Related U.S. Application Data

(63) Continuation of application No. 15/262,946, filed on Sep. 12, 2016, now Pat. No. 10,016,006, which is a continuation of application No. 15/057,938, filed on Mar. 1, 2016, now Pat. No. 9,462,841.

(51) Int. Cl.

| | |
|---|---|
| ***A42B 3/04*** | (2006.01) |
| ***A41D 13/05*** | (2006.01) |
| ***A63B 71/08*** | (2006.01) |
| ***A42B 3/08*** | (2006.01) |
| ***A42B 3/06*** | (2006.01) |
| ***A42B 3/12*** | (2006.01) |
| ***A42B 3/20*** | (2006.01) |

(52) U.S. Cl.

CPC ..... *A42B 3/0473* (2013.01); *A41D 13/0512* (2013.01); *A42B 3/064* (2013.01); *A42B 3/08* (2013.01); *A42B 3/121* (2013.01); *A42B 3/20* (2013.01); *A63B 71/081* (2013.01)

(58) Field of Classification Search

CPC .... A42B 3/00; A42B 3/06; A42B 3/28; A42B 3/125; A42B 3/283

USPC ..... 2/410, 413, 416, 421, 425, 468

See application file for complete search history.

(56) References Cited

U.S. PATENT DOCUMENTS

| | | | |
|---|---|---|---|
| 3,818,509 | A | 6/1974 | Romo et al. |
| 4,825,476 | A | 5/1989 | Andrews |
| 5,517,699 | A | 5/1996 | Abraham, II |
| 5,930,843 | A | 8/1999 | Kelly |

(Continued)

OTHER PUBLICATIONS

U.S. Office action, U.S. Appl. No. 14/718,583, dated Sep. 21, 2015.

(Continued)

*Primary Examiner* — Katherine M Moran

(74) *Attorney, Agent, or Firm* — Stout, Uxa & Buyan, LLP; Carlos A. Fisher

(57) ABSTRACT

The invention includes a protective headpiece and components thereof and methods for their use. Preferred examples comprise a helmet component, a plurality of piers joining said helmet component to a shoulder pad component and an inner hat component permitting the wearer the ability to move the head from side to side and/or up and down within the helmet component without moving the helmet component. The helmet component may comprise a plurality of fluid-filled floating plates or floats on the inner surface thereof to cushion the head against impact during activities including, for example, football, race car driving, military activities and the like.

20 Claims, 13 Drawing Sheets

(56) References Cited

U.S. PATENT DOCUMENTS

| | | | | |
|---|---|---|---|---|
| 6,968,576 | B2 | 11/2005 | McNeil et al. | |
| 7,115,747 | B2 | 10/2006 | Reeder et al. | |
| 8,613,114 | B1 | 12/2013 | Olivares Velasco | |
| 8,918,918 | B2 | 12/2014 | Jackson | |
| 9,027,163 | B1 | 5/2015 | Schmidt | |
| 9,205,320 | B2 | 12/2015 | Mason | |
| 9,462,841 | B1 * | 10/2016 | Popejoy ..... | A41D 13/0512 |
| 2001/0011388 | A1 | 8/2001 | Nelson et al. | |
| 2011/0011388 | A1 | 1/2011 | Johnston | |
| 2011/0277225 | A1 | 11/2011 | Salkind et al. | |
| 2013/0031706 | A1 | 2/2013 | Cooksey | |
| 2014/0237707 | A1 | 8/2014 | Lane | |
| 2014/0259319 | A1 | 9/2014 | Ross et al. | |
| 2015/0135413 | A1 | 5/2015 | Mayerovitch | |
| 2015/0157080 | A1 | 6/2015 | Camarillo et al. | |
| 2015/0208750 | A1 | 7/2015 | White | |
| 2015/0223542 | A1 | 8/2015 | Fishchell et al. | |
| 2016/0157543 | A1 | 6/2016 | Huang | |

OTHER PUBLICATIONS

U.S. Office action, U.S. Appl. No. 14/718,583, dated Nov. 17, 2015.

* cited by examiner

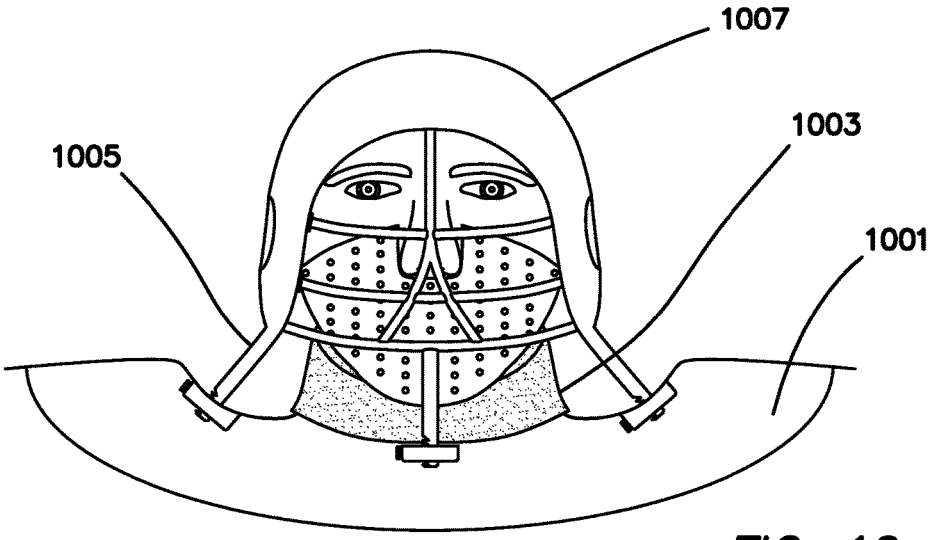
FIG. 10
FIG. 11
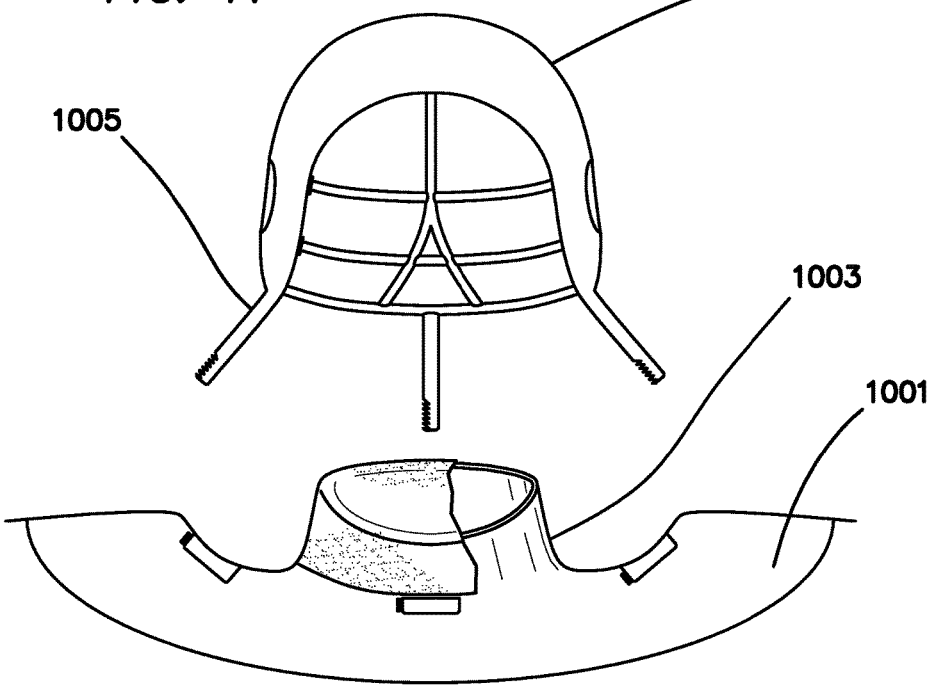

PROTECTIVE HEADGEAR AND SHOULDER PAD APPARATUS AND METHODS

SPECIFIC REFERENCE TO RELATED APPLICATIONS

This application is a continuation of U.S. patent application Ser. No. 15/262,946, filed Sep. 12, 2016 (now U.S. Pat. No. 10,016,006), which was a continuation of U.S. patent application Ser. No. 15/057,938, filed Mar. 1, 2016 (now U.S. Pat. No. 9,462,841), each of which is hereby incorporated by reference herein in its entirety.

BACKGROUND

The present invention is useful in sports, such as, without limitation, football (i.e., American, Australian and Canadian football), soccer, rugby, field and ice hockey, lacrosse, boxing and automotive and motorcycle racing. Additionally, the invention may find application in non-sporting activities such as military and spacecraft activities, in which bodily contact is common or the risk of collision or accident is high.

In such activities there may be a high risk of head injuries such as traumatic brain injury (TBI), as well as injuries to the neck, back, and spine. TBI is defined as damage to the brain resulting from external mechanical force, such as rapid acceleration or deceleration, impact, blast waves, or penetration by a projectile, that disrupts the normal function of the brain. TBI can result when the head suddenly and violently hits an object, or when an object pierces the skull and enters brain tissue. Immediate symptoms of a TBI can be mild, moderate or severe, depending on the extent of damage to the brain. Mild cases (mild traumatic brain injury, or mTBI) may result in a brief change in mental state or consciousness, while severe cases may result in extended periods of unconsciousness, coma or even death.

In addition to the immediate effects of TBI, which manifest at the moment of injury, TBI can also cause secondary injuries, a variety of events that take place in the minutes, days, and weeks (or longer) following the injury. These processes, which may include alterations in cerebral blood flow and the pressure within the skull, contribute substantially to the damage from the initial injury. Chronic effects, particularly of moderate and severe TBI include cognitive deficits, including impaired attention; disrupted insight, judgment, and thought; reduced processing speed; distractibility; and deficits in executive functions such as abstract reasoning, planning, problem-solving, and multitasking. These effects are also cumulative, at least in certain individuals, particularly upon repetitive TBI, such as the mild TBI commonly experienced by regular and professional football players.

A 2009 study ranked the 20 sports and/or recreational activities representing the categories contributing to the highest number of estimated head injuries treated in U.S. hospital emergency rooms in 2009.

TABLE 1

| SPORT/ACTIVITY | INJURIES TREATED |
|---|---|
| Cycling: | 85,389 |
| Football: | 46,948 |
| Baseball and Softball: | 38,394 |
| Basketball: | 34,692 |
| Water Sports (Diving, Scuba Diving, Surfing, Swimming, Water Polo, Water Skiing, Water Tubing): | 28,716 |

TABLE 1-continued

| SPORT/ACTIVITY | INJURIES TREATED |
|---|---|
| Powered Recreational Vehicles (ATVs, Dune Buggies, Go-Carts, Mini bikes, Off-road): | 26,606 |
| Soccer: | 24,184 |
| Skateboards/Scooters: | 23,114 |
| Fitness/Exercise/Health Club: | 18,012 |
| Winter Sports (Skiing Sledding Snowboarding Snowmobiling): | 16,948 |
| Horseback Riding: | 14,466 |
| Gymnastics/Dance/Cheerleading: | 10,223 |
| Golf: | 10,035 |
| Hockey: | 8,145 |
| Other Ball Sports: | 6,883 |
| Trampolines: | 5,919 |
| Rugby/Lacrosse: | 5,794 |
| Roller and Inline Skating: | 3,320 |
| Ice Skating: | 4,608 |

The American Society of Test and Materials (ASM) recommends that protective headgear be worn 100% of the time to reduce the risk of TBI in most high risk activities such as these.

As a result of the heightened awareness concerning the long term effects of TBI, as of Jun. 1, 2013, there were more than 4,800 former professional football players as plaintiffs in 242 concussion-related lawsuits against the National Football League. Furthermore, many current or former athletes, including long-time Chicago Bears coach Mike Ditka and quarterback Bret Favre and LeBron James, have stated that they would not permit their children to play football due to risk of cognitive deficits resulting from TBI.

In America football helmets made of leather were introduced in the late 19$^{th}$ century, with the introduction of the plastic football helmet in 1940. In 2002 a more spherical helmet, the Riddel REVOLUTION® helmet made of a polycarbonate shell and polyurethane and synthetic rubber foam on the interior surfaces, was introduced, and is now used by over 80% of professional football players. The maker of the REVOLUTION® helmet claimed that players wearing this helmet experience 31% fewer concussions compared to players wearing older style helmets. However, in 2011 a professor of neurology at the University of Michigan (and chair of the American Academy of Neurology's sports neurology section) testified before the U.S. Congress that "there is no significant data" in the study cited by the maker of the REVOLUTION® helmet to make the claim that the helmet reduced concussions by 31%, and the Federal Trade Commission subsequently required this claim to be removed from advertising of the REVOLUTION® helmet.

Various attempts have been made to make improved protective helmets. U.S. Pat. No. 3,818,509 (Romo, et al.) is directed to a football helmet having elastic straps at the sides and in the rear connected to the shoulder pads, to restrict or limit movement of the helmet upon an impact. There appears to be no added support for the head or neck in this design, and concussion or TBI does not seem to be addressed.

U.S. Pat. No. 5,517,699 (Abraham et al.) is directed to a helmet assembly designed to protect a wearer from cervical spine injuries. The patent discloses a helmet having a posterior flange that hooks under and behind a helmet support ring, or collar that is held in place by a frame connected to a shoulder plate.

U.S. Pat. No. 7,155,747 (Baker) is directed to a head stabilizing system for activities such as racing cars or boats, or for use in aircraft. The system is meant to protect the spinal cord, base of the skull, and the neck from injury during a crash. The system comprises a helmet, a connection structure (such as a shoulder pad), and at least one resisting member (such as a tether or dashpot) connected to the helmet and the connection structure. The piston may contain a viscous fluid that damps the impact by friction.

U.S. Pat. No. 6,968,576 (McNeil, et al.) describes a helmet providing cervical spine protection by having a pair of shock absorbers mounted to the sides and connecting to a pair of shoulder pads using ball-and-socket mounts. A "pilot-operated valve" is said to permit free movement of the helmet except when an impact is experienced by the helmet, which then causes the valve to become activated and thereby block hydraulic flow of fluid through tubes connecting the valve with the shock absorbers.

U.S. Patent Publication No. 2011/0277225 (Salkind, et al.) is directed to an apparatus to prevent user injury from rotational force or whiplash due to sudden impact. In this system a football helmet is connected to a body harness using a series of tethers and spools, similar to a seatbelt mechanism. Upon a predetermined movement of at least one tether, the spool will lock, preventing further movement of the tether. However, this system does not provide independent support to the neck.

U.S. Patent Publication No. 2011/0277225 (Castillo) is drawn to a head protection system comprising a helmet having a hard shell and a padded interior, a shoulder cuff and a series of pistons having a viscous fluid within connected to the helmet and shoulder cuff to as shock dampers.

U.S. Patent Publication No. 2014/0237707 (Lane) discloses an impact diversion system which includes a helmet system including a two-part ring configured to fit around the user's neck and at least one post connected to the helmet and having an end removably connected to the ring. The harness system of the Lane publication includes a first half and a second half that fit around the user's torso.

All patents, patent applications, and non-patent publications referenced in this specification are hereby individually incorporated herein by reference in their entirety.

There remains a need for effective and improved protective headgear for use by various recreational, military and professional users, including both children and adults. Such headgear should be capable of substantially lessening the risk of TBI and neck, spine and back injury caused by a blow or force applied to the head, and the incidence of TBI (e.g., expressed as a percentage in a population of users) as compared to previously used helmets and protective headgear.

SUMMARY

In a broad example, the present invention is directed to methods and apparatus for preventing or reducing the severity of traumatic brain injury (TBI), neck, spine and/or back injury, through the use of protective headgear which is not supported, or is structured not to be substantially supported by the wearer's head.

Thus, in a particular example, the present invention is drawn to a protective headpiece comprising a helmet component having an interior surface, an exterior surface and optionally, depending upon the use thereof, a face mask component. The exterior surface of the helmet component preferably comprises an outer protective shell, such as one made from a durable material such as a hard, impact-resistant polymer. Such polymers, which are preferably strong and lightweight, may include any suitable polymer; the majority of football helmets are made using a polycarbonate component. However, in other examples, the exterior surface of the helmet component may comprise a "soft" shell, such as a viscoelastic polymer component covering a hard shell component underneath, to reduce the force experienced by the wearer. Such viscoelastic polymers include "memory foams" such as low-resilience polyurethane foam. If present, the soft shell component may in some cases be designed as an outer covering which can be affixed in place using a hook and loop type fastener, such as a VELCRO® fastener.

In certain examples of the invention the inner surface of the helmet component may comprise one or more padding component, such as a foam or fluid-filled padding component. The padding components may comprise bladder-type "floats" or padding having a fluid-tight, fillable interior space or void, or a non-bladder padding component. The helmet component may comprise a combination of both bladder-type and non-bladder padding components. The padding may be made of any suitable polymer, such as a polyurethane, or a vinyl polymer, such as vinyl nitrile or materials having similar properties. The paddings may have different densities based on their location in the interior of the helmet component, with, for example, the densest padding being in the region (in football, generally the forehead area) most likely to take the majority of the impacts.

In other examples, the interior of the helmet component may comprise, or be, at least one, and preferably a plurality of "floating plates" or floats to facilitate some movement of the head (for example, from side to side or up or down) within the helmet. The floating plates or floats may comprise a fluid-filled bladder; for example, the fluid may be air or gas, or a fluid such as a silicone liquid, for example, a high molecular weight silicone preferably having a high specific gravity. The bladders may be made from any suitable material, for example, they may comprise a lightweight, strong material such as poly-paraphenylene terephthalamide (KEVLAR®) or a material having similar properties.

In some examples the floating plates or floats may be set within the helmet component, for example, within a molded or formed indentation on the interior portion of the helmet component. For example, in some examples one or more such float or floating plate may sit within a shallow depression about 0.5 inch to about 1 inch deep set inside the inner surface of the helmet component. In preferred examples a plurality of floats, such as side floats positioned to protect either side of the head, a front float, a rear float and a top float to contact the crown of the head may be present.

The floats may be fluid-filled containers, for example about the size of a small plate, while the top float may be somewhat larger and shaped to fit the crown of the head (for example partially concave) and located on the top of the inner surface of the helmet component. In some examples, the top float may be structured to slide and/or to rotate about a spindle or axis in a manner similar to a "Lazy Susan", thereby permitting the wearer's head to turn from side to side within the helmet.

In certain examples the side, forehead and/or rear floats are fluid-filled and rollable along an axis. For example, the floats may be in the approximate shape of a hair roller and mounted on an rolling axel; an axel of the side floats may be positioned approximately vertically. An axel of the forehead and/or back float may be positioned approximately horizontally. Preferably under normal circumstances the wearer's head may not make contact with the floats. However, when the helmet receives a blow, it may be expected that the helmet will momentarily distort inward at the point of the blow; the floats would then be effective to both cushion the head and to permit the head to move from side to side, thus allowing some freedom of motion and permitting the head to move to avoid the full force of the blow.

Thus, in an important example, the helmet component of the present invention is structured so that the inner surface thereof makes no direct contact, or minimal direct contact, with the wearer's head (except in certain examples, at the crown of the head against the float within the helmet). In this way, the wearer may move the head within the helmet component without the helmet component itself moving. By "head" is meant the cranium and/or the cranium and the facial bones, but is not meant the mandible alone. For instance, in some examples the helmet is adapted to leave sufficient space between the inner surface of the helmet and the outer surface of the inner hat component (described below) to permit the wearer to move his or her head freely within an angular range. The space between the inner surface of the helmet and the outer surface of the inner hat component may comprise about 0.5 cm, or about 1 cm, or about 1.5 cm, or about 2 cm or more. In some instances the vertical angular range of head movement (up and down) may be within a range of about 45 degrees, or about 40 degrees, or about 35 degrees, or about 30 degrees, or about 25 degrees, or about 20 degrees of about 15 degrees In some instances the horizontal angular range of head movement (side to side) may be within a range of about 45 degrees, or about 40 degrees, or about 35 degrees, or about 30 degrees, or about 25 degrees, or about 20 degrees of about 15 degrees.

Additionally, the minimization or absence of direct contact between the helmet component and the wearer's head lessens the likelihood, particularly when used in conjunction with the mechanism transferring impact force to a shoulder or body harness structure to be described below, that an impact received by the outer shell of the helmet component will be transmitted to the head or brain of the wearer.

The floats may be structured to be integral to the helmet component, or may be structured to fit or be secured within the depressions or shallows when the helmet component is worn using, for example, hook and loop-type fasteners or webbing and straps.

In preferred examples of the present invention, the headgear apparatus of the present invention comprises a separate inner hat component, which may be a "soft", preferably padded, hat component, closely fitting the wearer's head. The inner hat component is lightweight and may be comprised of, for example, a polymeric material having a cushioning property. In some examples the inner hat component may, when worn with the outer helmet, be situated proximal to one or more floats the inside of the helmet component and can be firmly secured to the wearer's head using, for example, one or more preferably well-padded chin strap. Very preferably the inner hat component includes padding comprising a mask component and/or forehead components to prevent injury to the forehead, mouth and nose resulting from a blow forcing the face against the facemask of the helmet.

The hat component is structured and designed to interact with the helmet component so as to allow a range of motion for the wearer, thereby permitting wearers to move the head and inner hat component independently of the outer helmet component to adjust their view within a range of vision while wearing the protective headgear apparatus of the present invention.

In some preferred examples, at least a portion of the outer surface of the inner hat component is substantially smooth, and may be at least partially coated with a material having low friction, such as a material comprising polytetrafluoroethylene (PTFE), sold under the trade name TEFLON®. In some of these preferred examples, at least a portion the interior surface of the helmet component may also similarly may be at least partially coated with a material having low friction(e.g., PTFE); when the wearer experiences a blow to the helmet, the head and inner hat component may move independently of the outer helmet component with lower friction than if one or both surfaces were not coated with the low friction material. In some examples, at least a portion of the surface of the floating plates may be at least partially coated with a material having low friction (e.g., PTFE). In some examples, the floats or other padding may be located under a "skin" of the helmet component at least partially covering the interior surface of the helmet component; this skin may be substantially smooth, thereby permitting the inner hat to skid off the interior part of the helmet when a blow is experienced. In some examples, the interior surface of the helmet component may not comprise floating plates, but may be appropriately padded, for example, with a foam.

As described above, in important examples, the helmet component and the inner hat component are structured and fitted in a manner such that a space or gap is maintained between the inside of the helmet and at least a substantial part of the outer surface of the inner hat during normal circumstances.

Preferably, the helmet component has a wider, and optionally higher, face opening than a conventional football helmet. Since the helmet makes no direct contact, or only minimal direct contact, with the inner hat, and is preferably sized to maintain a gap between the inner hat and the helmet, the helmet component may be larger than a conventional football helmet in some examples. For e.g., sports applications the helmet component may also comprise a face mask component, such as a metal or polymer-coated metal "birdcage" type face mask component similar to those in current use. Preferably, the face mask component will be larger than conventional faceplates to accommodate the helmet component's larger face aperture in some examples of the present invention.

In important examples of the present invention the helmet component is either permanently or (preferably) connectably affixed to a shoulder pad component. Unless indicated otherwise expressly, it will be understood that the term "shoulder pad component" refers to a protective piece of equipment comprising a shock absorbing pad material with a hard plastic outer covering. As used in this specification, the protective equipment denoted the "shoulder pad component", like the "shoulder pad", substantially covers the top portion of each of the two shoulder joints. As used herein, the shoulder joint comprises the part of the body where the humerus attaches to the scapula, the head sitting in the glenoid cavity, and is synonymous with the glenohumeral joint. The term "shoulder" or "shoulder(s)", as used herein, means the shoulder joint and nearby structures, but excludes the neck, the portion of the clavicle that makes contact with the spine, or any portion of the spine. As used in this specification, the term "shoulder pad component" does not refer to any structure or apparatus in which a rigid post or pier supporting the helmet component is connected directly to a ring or collar configured to fit around a user's neck and rest on the neck or clavicle of the user, whether or not such ring or collar is otherwise part of a shoulder pad component as otherwise described above. Preferably, such a structure or apparatus is expressly disclaimed as within the scope of this invention.

The shoulder pad component of the present invention is thus adapted to cover at least the top portion of the wearer's shoulders. Additionally, the shoulder pad component comprises an important part of a force-dissipating unitary engineered assembly or network linking the helmet component, the rigid piers, and the shoulder pad component. Thus, the shoulder pad component does not comprise a harness system comprising a vest (a sleeveless garment that does not cover the shoulder joint) adapted to be fastened around the user's torso, The shoulder pad component very preferably includes a plurality of rigid force-directing members, which may comprise, without limitation, natural, elastomeric, metallic, or synthetic fibers or materials (or a mixture of any of these), rods, or narrow flexible strips (battens) permanently or removably integrated as part of the shoulder pad component. In one example, the force-directing members may be arranged in a manner similar to the roots of a tree, so as to diffuse the force of a blow to the helmet transmitted through the piers (described below) and then throughout the force-directing members of the shoulder pad apparatus to the shoulders and upper body and away from the head. As a result, the shoulder pad component will transfer the force of as blow to the chest and shoulder rather than to the head, neck or collarbone. In use, the shoulder pad component of the present invention As used in this specification the term unitary engineered assembly" or "unitary engineered network" means a combination of the helmet component comprising integrated rigid piers connected or the connectable to shoulder pad component, and the shoulder pad component itself, comprising force-directing members, as exemplified above.

As discussed above, the helmet component is made to function as a strong unitary engineered assembly with the shoulder pad component, thereby transferring impact force applied to the helmet to the shoulders and/or body rather than the head, neck and/or spine.

Thus, in preferred examples, the helmet component is fabricated to contain a plurality of integral bars or "piers" that connect the helmet component to the shoulder pad component and support the helmet during use. The piers may be located at the back, sides and front of the helmet, for example, there may be four piers, with one located in the front, one in the back, and one of each side of the helmet. In other examples there may be more or less than four piers.

The piers are strong enough to absorb at least a portion of the force transmitted by a direct impact to the helmet, but in one example are also preferably flexible enough to absorb some of the force of a hard impact; the piers are preferably structured to absorb torque forces as well. However, in other examples, the piers are substantially non-flexible.

The piers may be manufactured using, for example, a core made from a suitably strong and lightweight material, such as one or more of titanium, a titanium alloy, a non-titanium metal, a nanostructured ceramic, a nanostructured metal or metal alloy, a thermopolymer, or a carbon polymer. Preferably the piers are integrated into the helmet component as part of the structure of the helmet (e.g., during the manufacturing process), such as through a engineered network connecting the piers within the helmet to help diffuse and distribute impact forces throughout the helmet component into each of the piers and thereby evenly transfer the force to the shoulder pad component.

In some examples (for example, ones in which the piers are non-removable from the shoulder pad component) the piers may be integrated into the shoulder pad component so as to make the helmet component and the shoulder pad component a single structure. In these examples, the piers may be integrated into the shoulder pad component in a manner similar to their connection to the helmet component, such as through an engineered network connecting the piers within the shoulder pad component (which may contain force-directing members as described above) to help better diffuse impact forces along the shoulders.

In these examples, therefore, the helmet component and the shoulder pad component together comprise a single unitary engineered assembly which can be used by placing the shoulder pads over the head, and then lowering the assembly so that the helmet component fits onto the wearer's head. However, in other examples, the piers are connectable to and removable from the shoulder pad component, and are not permanently integrated therein.

The shoulder pad component may generally consist of a hard plastic shell with foam or fluid filled padding underneath. The pads fit over the shoulders and the chest and rib area, and may be secured with various snaps and buckles, for example, at the front of the chest or near the bottom of the shoulder pad component. In preferred examples, the shoulder pad component does not comprise a strap system For connecting the shoulder pad apparatus to the user's clothing. Preferably the shoulder pad apparatus does not comprise two halves (such as a front half and a back half) fitted together by a closure assembly. In use, the shoulder pad assembly is very preferably not worn under or in conjunction with protective equipment or padding, and does not incorporate attachment sites for "traditional shoulder pads", or a strap system extending from attachment points on the shoulder pad apparatus to the user's pants, belt or jock strap.

In the present invention, the piers are preferably integrated within, or joined to, the shoulder pad component so as to distribute impact forces experienced by the helmet to the shoulder pad component and thence throughout the shoulder pad component by way of the force-directing members within the shoulder pad component, in this way, the concussive force applied to the head is deflected from the head and brain to the shoulders and chest by a unitary engineered assembly or network. In some examples, the piers may be joined to a shock-absorbing component, such as a short-stroke compressible pneumatic or hydraulic shock-absorbing component located, for example, either at the junction between the pier and the shoulder pad component, or (less preferably at the juncture between the helmet component and the pier component. The stroke of the shock absorbers may be about one inch or less, such as about ¾ inch, or about ½ inch or about ¼ inch. The shock-absorbing component may be structured to be part of, or securely connectable to, the shoulder pad component (for example, within a pocket, depression, or recess within the shoulder pad component) to avoid possible unintentional contact with equipment or other players during activities.

In other examples the shock absorbing element may comprise a hard. elastomeric material structured to compress substantially only under a force having a magnitude of a blow to the helmet, such as a force of 25 G (25 times the force of gravity) or more, or 50 G or more, or 75 G or more, or 1000 or more.

The piers are preferably capable of withstanding and distributing impact forces of up to one ton or more. It has been estimated that an average-sized National Football League defensive back (about 5 feet 11 inches in height and weighing 200 pounds) is capable of an average speed of 40 yards in 4.5 seconds. This combination of speed and mass can result in 1,600 pounds of tackling force. Simulating impact forces on an object the size and weight of a human head (about 20 pounds) dropped two feet onto a football field yields a metric in multiples of gravitational force. Walking exerts about 1 G on the object. An F-16 fighter roll exerts about 9 G, while a concussion exerts about 100 G, and an extreme football impact exerts about 150 G on the head.

Thus, preferably the piers of the present invention are capable of withstanding a force of up to 100 G, or up to 125 G, or up to 150 G, or up to 175 G, or up to 200 G, or more without breaking, cracking, or becoming separated from either the helmet component or the shoulder pad component, In preferred examples, the helmet component may be structured to be removable from the shoulder pad component. For example, the piers may comprise one or more quick-release mechanism to permit the helmet component to be removed quickly in the event of an injury. These quick-release mechanisms should be capable of activation both the wearer or by another person (such as a medical technician or doctor), but should be structured in a manner that prevents unintentional activation of the quick-release mechanism during play or other activity, or malicious removal by an opposing player.

Examples of suitable quick-release mechanisms are well known to those of ordinary skill in the art, and may comprise any suitable quick release mechanism. Thus, such a quick release mechanism may comprise (without limitation) quick-release pins, which can be pulled to separate the piers from the helmet component or shoulder pad component, gimbaled latch mechanisms similar to those disclosed in U.S. Patent Publication. No. US 2014/0259319, loops and clasps, combiners and the like. In some examples, the quick-release mechanism may be integrated into the system in conjunction with shock absorber-type components connected to or associated with the piers, if these are present. Thus, the quick release mechanism may comprise pier connectors located at the downward end of each pier.

Additionally, certain of the examples of the present invention may include one or more quick-release mechanisms for the face mask of the helmet component such as hinges on one side of the face mask and one or more quick-release latch on an opposing side, permitting it to be removed or opened when the player is on the sidelines or bench, thus permitting the wearer to eat or drink, or for emergency medical aid to be provided when and as necessary. A particular example of a quick release mechanism for the face mask may comprise a heavy duty hinge or plurality of such hinges securing the face mask to the helmet component on one side of the face aperture, with one or more releasable heavy duty latch component locking the face mask in place at an opposing side of the face aperture.

In preferred examples of the invention, shoulder pad incorporates a force-diffusing component to which the piers from the helmet component are partly or wholly joined. In one example, the force-diffusing component may comprise a roughly circular or ovoid reinforcement element supported on top of the shoulders around the neck opening (i.e., supported by the clavicles, upper ribs, sternum and scapulae and overlying muscles), and integrated as part of the shoulder pad assembly as a whole. When used as a separate element of the invention this element generally comprises a similar construction as that found in the shoulder pad component; for example, a hard plastic shell capable of rigidly, but flexibly, distributing shock forces received from the helmet component through the piers to the force-diffusing component. The underportion of the force-diffusing component is lined with padding, such as an elastomeric polymeric foam. In preferred examples, this force-diffusing element may be integrated into, joined with, or embedded as part of the shoulder pad component. As referenced herein, the force-diffusing element will be regarded as part of the shoulder pad component unless specifically indicated as being absent, support for which specific indication is hereby provided.

The force-diffusing element preferably comprises a mating connector component structured to accept and securely hold the piers of the helmet component, thus rendering the helmet as a unitary structure with the shoulder pad component. In one example of such a mating structure component, the force-diffusing element may comprise a plurality of loops located on the circumference of the forced diffusing component and directly under the helmet piers when the helmet is placed on the head over the shoulder pad assembly. These loops are preferably integrated into a reinforced portion of the force-diffusing element, which may comprise, for example, a cable core surrounded by hard polymer. The loops are sized to be able to be connected to, for example, hook snap or leach type snap pier connectors. Furthermore, regardless of the specific type of connecter used, in preferred examples of the present invention, the mating connector component is an element of the force-directing components contained in the shoulder pad component.

In particularly preferred examples the shoulder pad component may comprise a collar component to dampen side-to-side and/or front to back movement of the head upon impact, and helps protect the contact of the head with the interior of the helmet as well as protecting the wearer from neck injury (such as whiplash) as a result of a blow during play or other activity. In no embodiment or example of the present invention does the collar component comprise a mating connector, such as a socket, capable of the present invention receiving one end of a pier connected, at its other end, to a helmet component, and in no case does a unitary engineered system (or network) of the present invention, or a shoulder pad component of the present invention comprise a ring resting on the neck or shoulders which is directly connected or connectable to such a pier.

The collar component may be, and preferably is, integrated as part of, of affixed to, the shoulder pad component and/or the force diffusing element around the neck, and, depending upon the particular design of the shoulder pad component, may project above the shoulder pads about one to about four inches, sufficiently to cushion contact of the neck and base of the head with the helmet interior as a result of an impact. Preferably, when viewed from the outside, the collar has a slight to moderate concave curvature, supporting the back of the neck, The collar component is preferably supported internally by one or more strong, somewhat flexible material, such as, without limitation: metal, a strong flexible polymer, carbon fiber, or fiberglass, cushioned with padding where the collar makes contact with the neck or head. For example, the collar may comprise a set of "staves", for example, wider than they are thick, arranged in a manner similar to fence staves, around the circumference of the neck. The staves may be covered with a cushioning material, either individually or collectively. The staves are preferably integrated as part of, of affixed to, the shoulder pad component and/or the force diffusing element around the neck. An advantage of a collar component having such a "stave" design is that each stave may bend or flex on its own, without substantially affecting the position of other staves.

In some examples, the present invention may be structured, and/or provide, for the helmet component to be placed on the head after the shoulder pad component has been put on and fitted, in a manner similar to how the helmet of a deep sea diving suit is placed on the head and secured to the suit after the diver has put the remainder of the suit on. In such examples, the piers of the helmet component may terminate in a fixture, for example, a circular, ovoid, or diamond-shaped fixture, that can then be firmly mated with or joined to a corresponding shoulder pad component fixture (such as, without limitation, a force-diffusing component), preferably using quick-release fasteners.

In other examples, the helmet component may comprise a plurality of piers extending generally downward therefrom with pier connectors at or near the lower portion of one or more pier. Preferably, at least four piers have connectors located at or near their lowest point. Each connector may be structured to fit and lock to a corresponding connector receptacle located on or in the shoulder pad component. In some examples, the connector receptacle may be embedded within the body of the shoulder pad component; for example, such a connector receptacle may comprise a small shock-absorbing component connected to the force-diffusing component of the shoulder pad with a shock diffuser plate underlying each receptacle point. Each connector of the helmet component piers may fit into, and lock within its corresponding receptacle, such as by a "locking slide mechanism", such as using a heavy duty latch buckle, such as one made from a strong polymer, metal, or metal alloy. In such cases the connector receptacle is preferably an element of the force-directing components contained in the shoulder pad component.

In another example, the pier connectors may comprise an attachable or integrated snap hook, such as a dog leash-type snap, or a mountaineering snap hook. The hook or leash-type snap should be able to be secured against accidental opening, such as with a screw-down lock.

BRIEF DESCRIPTION OF THE DRAWINGS

FIG. 10 shows a shoulder pad component comprising a collar component.

FIG. 11 shows the apparatus of FIG. 10 in which the helmet component is removed to show the attached collar component.

DETAILED DESCRIPTION OF THE INVENTION

Figure 1A:
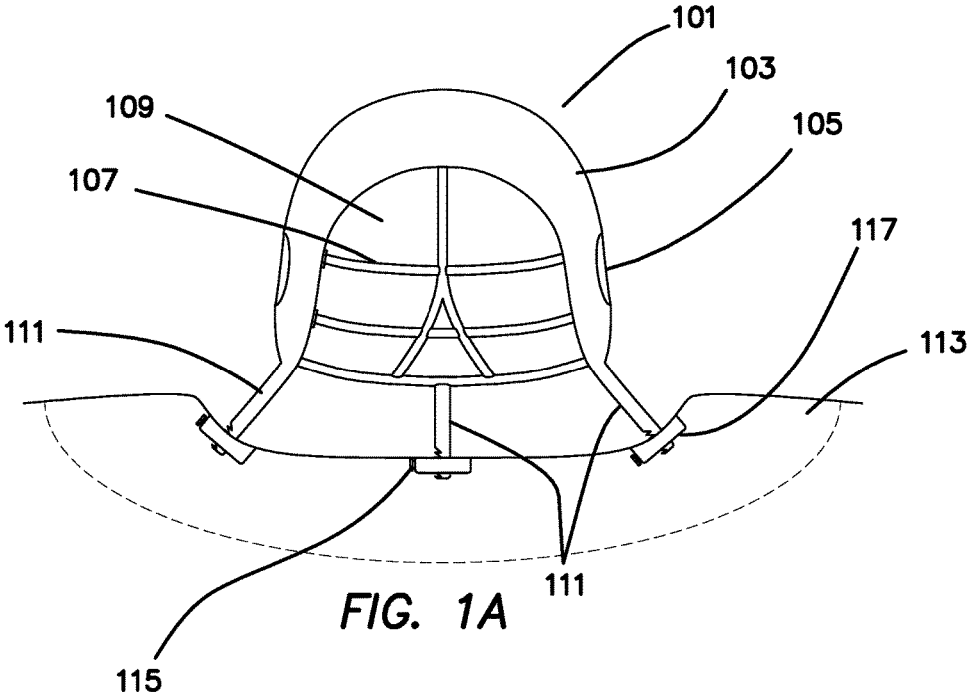
FIG. 1A shows a frontal view of one example of a helmet component/shoulder pad component assembly of the present invention.

FIG. 1A is a front view of an exemplary protective headgear apparatus of the present invention. The helmet component 101 of this example comprises a hard shell 103 substantially surrounding the back and sides of the wearer's head; in other examples at least a portion of the outer surface of the helmet component may comprise padding overlying a hard shell. When in use, the helmet component may be substantially stationary and fixed with respect to the shoulder pad component 113, with little or none of the helmet's weight applied to the wearer's head. Accordingly, the front portion of the helmet component may comprise, for example, a "birdcage-style" face mask 107 structured and designed in a manner similar to standard football face masks, or face masks containing any suitable number of bars in any other shape sufficient to provide protection of the wearer's face. The face mask bars 107 may be comprised of metal, for example a plastic- and/or elastomer-covered metal. However, the size (particularly, but not necessarily exclusively, the width) of the face mask, and the corresponding frontal aperture 109 of the helmet component are each preferably larger and/or wider than traditional football helmets, since the wearer's head is preferably not restricted from moving substantially within the interior of the helmet component. Other face masks, such as transparent face masks, may be used in other examples of the present invention, such as racing or military applications.

The helmet component 101 may further comprise ear holes 105 permitting the wearer to more clearly hear spoken commands or plays. Alternatively or optionally one or more wireless speakers may be placed proximate the wearer's ear(s) within the interior of the helmet component so that, for example, a coach or trainer may advise the wearer of important information, such as comments, strategy, or plays by radio or wireless transmission.

Figure 1B:
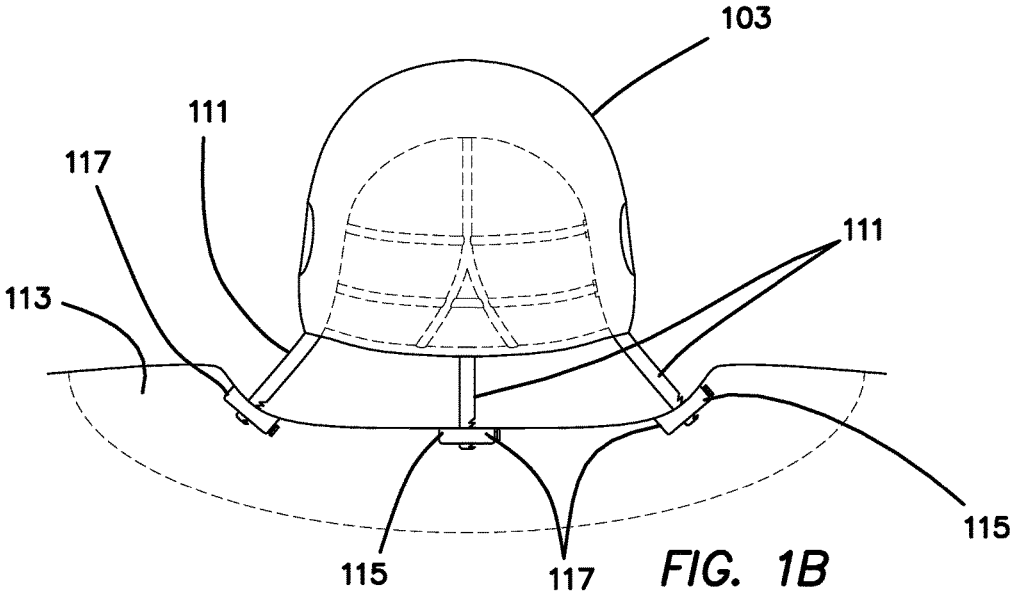
FIG. 1B shows a rear view of the example of the helmet component/shoulder pad component assembly shown in FIG. 1A.

The helmet component of the example shown in FIG. 1A has four piers (111; only three visible in this view) joining the helmet component to the shoulder pad component 113 and extending substantially downward from the helmet component. In other examples the number of piers may vary. The piers 111 are preferably strong and may be substantially inflexible. Preferably the piers are comprised of a rigid, strong material such as a metal, metal alloy or carbon fiber polymer that is integrated as part of the helmet component during its manufacture, in which the piers are connected within the helmet in such as manner as to distribute the force of a blow to any portion of the helmet component among the plurality of piers. The lower portion of each of the piers preferably comprises a connector component 115 structured to join securely and firmly within a corresponding connector receptacle 117 of the shoulder pad component 113. Very preferably, the pier connector component 115 and the connector receptacle 117 of the shoulder pad component 113 are structured to be rapidly releasable, thereby permitting the helmet component 101 to be quickly removed by the player or by a doctor, coach, or medical technician, if desired. In FIG. 1A and FIG. 1B, the exemplary quick release mechanism comprises barbs on the connector components of the piers, with as locking connector receptacle similar to these holding automobile headrests.

In some examples, the connector receptacle component 117 may be wholly or partially embedded beneath the surface of the shoulder pad component 113, (for example, as part of a force-diffusing component) where it is integrated with the force-directing members of the shoulder pad component.

FIG. 1B shows a back view of the same exemplary helmet/shoulder pad assembly shown in FIG. 1A. Thus, the helmet component shell 103 is shown with piers 111 (integrated into the helmet component) and joined to the shoulder pad component 113 via pier connector components 115 and connector receptacle components 117 wholly or partially embedded beneath the surface of the shoulder pad component 113, (for example, as part of a force-diffusing component) where it is integrated with the force-directing members of the shoulder pad component.

Figure 2:
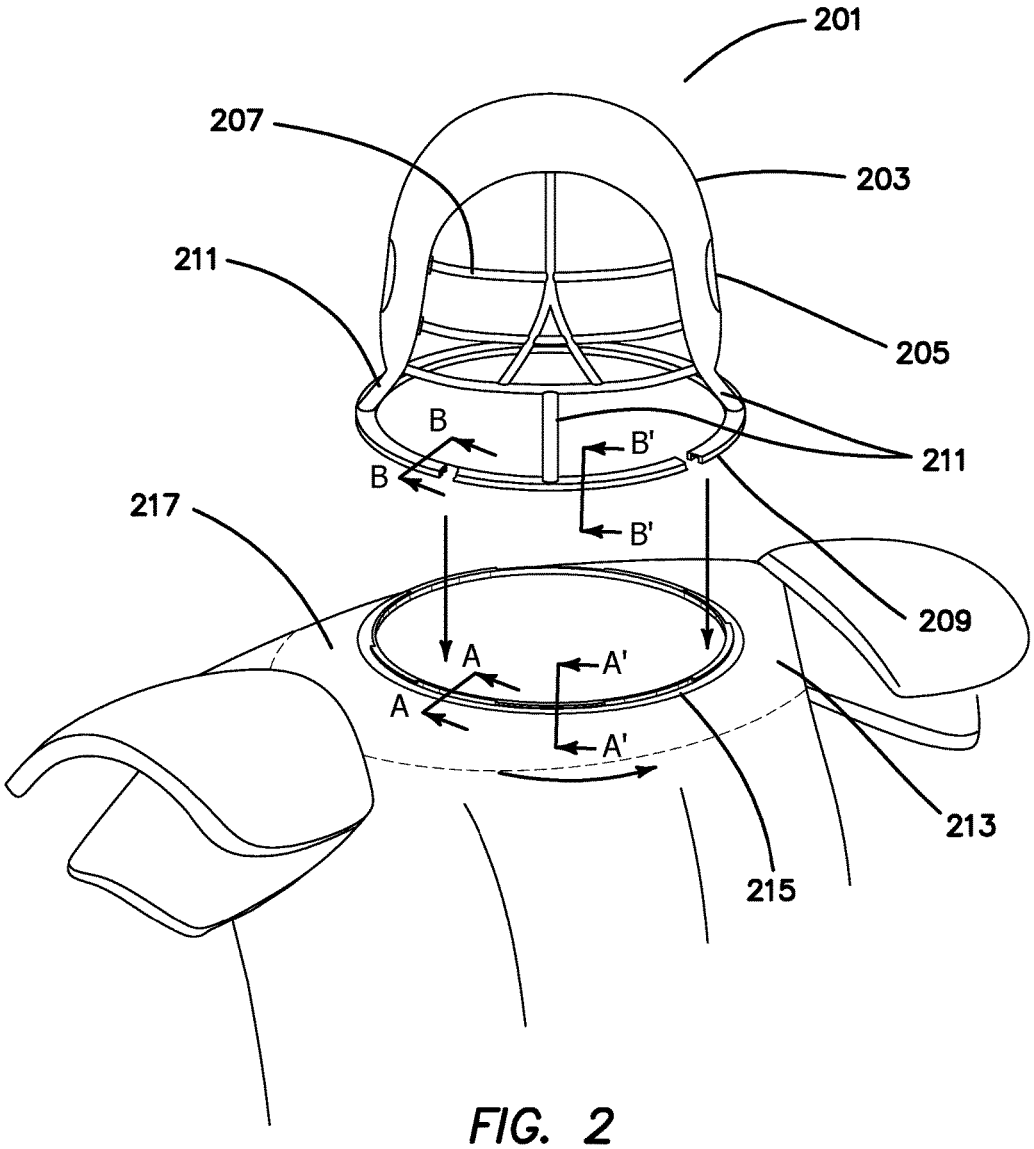
FIG. 2 is a frontal view of another example of a helmet component/shoulder pad component assembly of the present invention.

FIG. 2 shows a helmet component 201 in an alternative exemplary design. In this example, the helmet component shell 203 having ear holes 205, face mask 207 and piers 211 integrated as part of the helmet is substantially similar or identical to that depicted in the example shown in FIG. 1A and 1B. However, the piers terminate at their lower ends in a ring structure 209 encircling the neck of the wearer. The ring structure may be comprised of a lightweight, strong material able to withstand repeated mechanical shock and blows; for example, the ring structure may comprise a lightweight metallic element such as a titanium alloy; a polymeric material, a fiberglass material or a carbon fiber material. Particular care should be given to the strength of the joint between the piers and the ring structure. In certain examples the helmet component 201, piers 211 and ring structure 209 may be manufactured as a single piece in a process comprising casting or molding (for example, injection molding) of the structure as a unit.

The ring structure 209 is structured to mate with a mating collar structure 215 comprised or joined as part of the shoulder pad component 213. Preferably, the mating collar structure 215 is comprised in or as part of a force-diffusing component 217 which, in turn may be integrated as part of the shoulder pad component (for example, as part of a force-diffusing component), where it is, in turn, integrated with the force-directing members of the shoulder pad component to form part of a unitary engineered network.

The ring structure 209 and the mating collar structure 215 may mate in any suitably strong manner to firmly and strongly secure the helmet component 201 to the shoulder pad component 213 when is use. However, it is very preferable that the helmet component and/or face mask be able to be easily and quickly removed from the mating collar component by the wearer or by, for example, a trainer, doctor, or emergency medical technician. The mating collar structure 215 should be strongly attached to, embedded within, or made (for example, formed or cast) as part of, the force-diffusing component 217 or shoulder pad component 213.

Figure 3A:
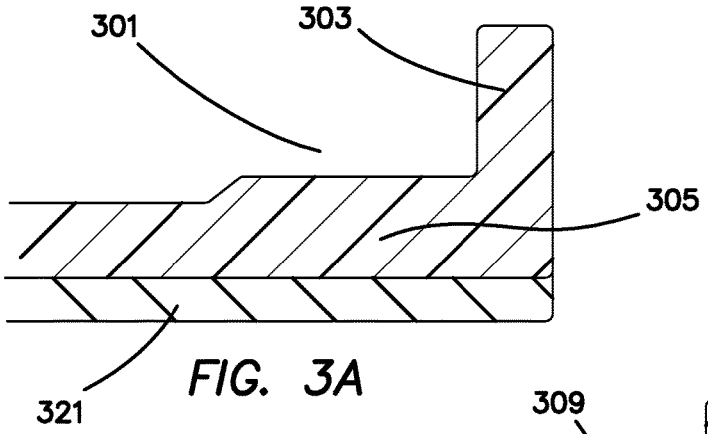
FIG. 3A shows a cross-section through line A-A of the mating collar structure used in the helmet component/shoulder pad component assembly of FIG. 2.
Figure 3B:
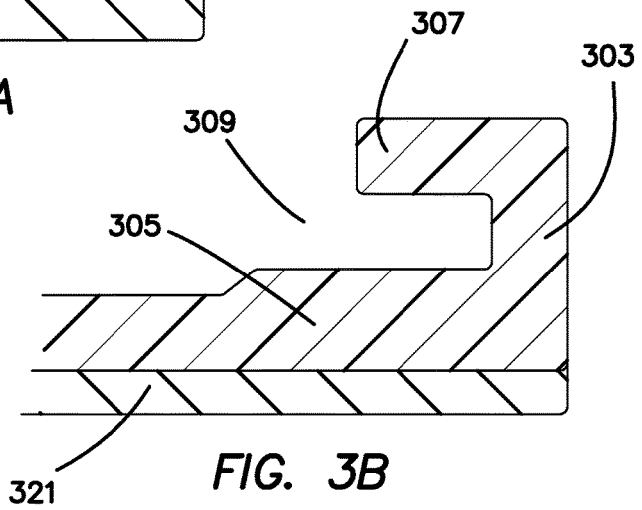
FIG. 3B shows a cross-section through line A'-A' of the mating collar structure used in the helmet component/shoulder pad component assembly of FIG. 2.

The manner of the connection between the ring structure and the mating collar structure may be of any suitable design. In one example, shown in FIG. 3A (a cross-section through line A-A of FIG. 2), the mating collar structure comprises a shape resembling an "L" 301, this L shape having an upwardly vertically extending component 303 and a bottom horizontally extending component 305. The L-shape may be interrupted at intervals (for example, at regular intervals) with an upper intermediate horizontally extending component 307,shown in FIG. 3B (a cross-section through line A'-A' of FIG. 2), rendering a mating collar structure having a "C" cross sectional shape 309 at such locations. In this example, the top horizontally extending component 307 extends transversely partially around the circumference of the mating collar structure's upwardly vertically extending component 303.

Figure 3C:
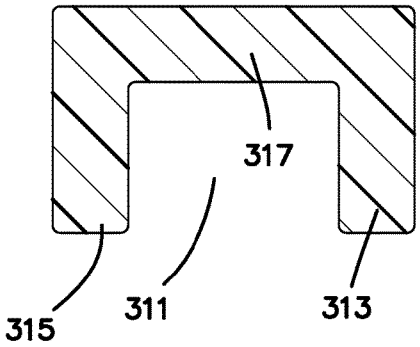
FIG. 3C shows a cross-section through line B-B of the ring structure used in the helmet component/shoulder pad component assembly of FIG. 2.
Figure 3D:
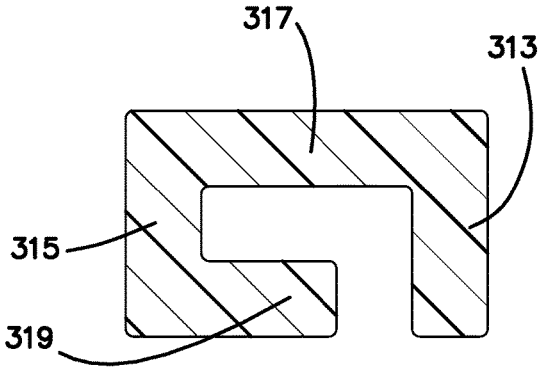
FIG. 3D shows a cross sectional through line B'-B' of the ring structure used in the helmet component/shoulder pad component assembly of FIG. 2, comprising a lower intermediate horizontally extending member.

As shown here, the mating surfaces of the ring structure joined to the helmet component (FIG. 2, 209) are complementary to the mating surfaces of the mating collar structure 215 described above. Thus, in the example depicted in FIG. 3C (a cross-section through line B-B of FIG. 2), the ring structure comprises a mating surface 311 comprising an inverted "U" shape in cross section, and having an inner downwardly extending vertical component 313, an upper horizontally extending component 317, and an outer downwardly extending vertical component 315. As shown in FIG. 3D (a cross-section through line B'-B' of FIG. 2), intermittently; for example, at intervals substantially identical to those of the mating collar structure, this inverted "U" shape may be interrupted with a lower intermediate horizontally extending member, see FIG. 3D, 319.

Figure 3E:
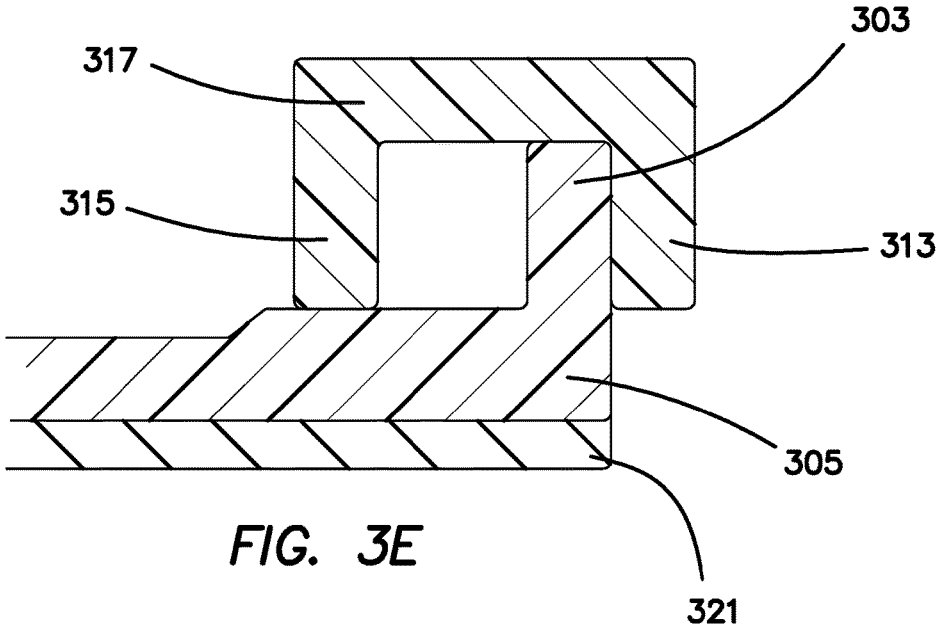
FIG. 3E shows the cross-sectional arrangement of the mating surfaces of the ring structure and the mating collar structure of FIG. 2 when the unitary helmet component/pier/ring structure assembly is placed on the mating collar structure in an "offset", unlocked position.

FIG. 3E is a depiction of the cross-sectional arrangement of a portion of the mating surfaces of the ring structure and the mating collar structure when the unitary helmet component/pier/ring structure assembly is placed on the mating collar structure in an "offset", unlocked position. In this state, the upward extending vertical component 303 of the mating collar structure fits between the inner downwardly extending vertical component 313 and outer downwardly extending vertical component 315 of the ring structure. The lower surface of the outer downwardly extending vertical component 315 of the ring structure may rest upon the lower horizontally extending component 305 of the mating collar structure. The mating collar structure preferably is structured as part of the force-diffusing element of the shoulder pad component, and may comprise a hard elastomer 321 or other shock-absorbing element underlying the lower horizontally extending component 305. The hard elastomer is chosen to compress only at the greater forces associated with a blow or "hit".

Figure 3F:
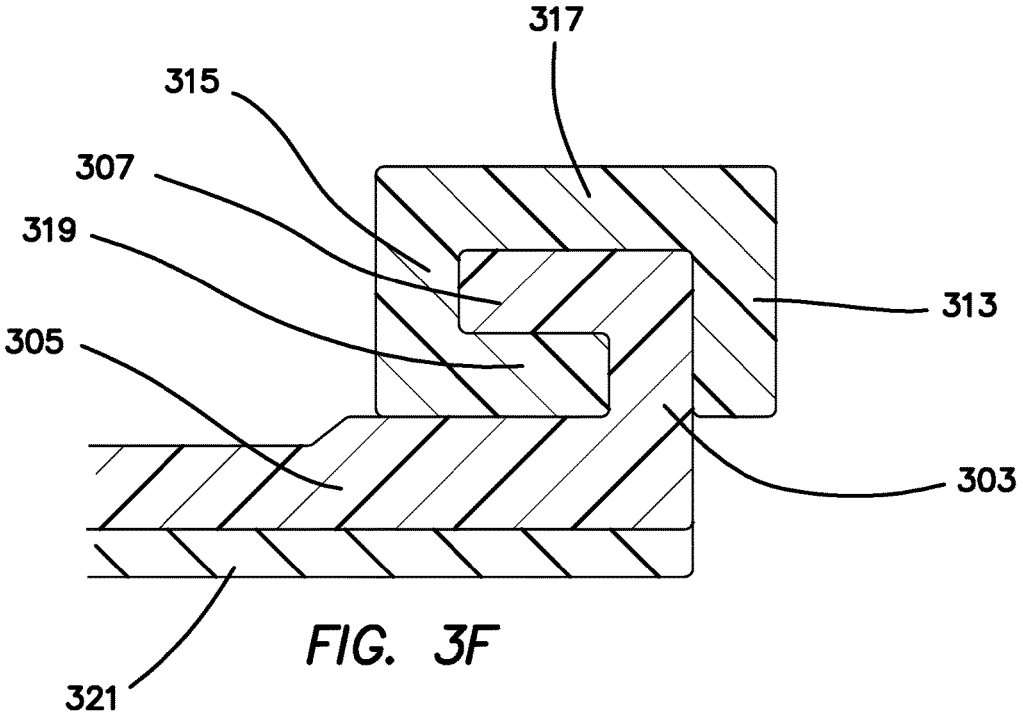
FIG. 3F the cross-sectional arrangement of the mating surfaces of the ring structure and the mating collar structure when the unitary helmet component/pier/ring structure assembly is rotated from the "offset" position of FIG. 3F into a "locked" position.

FIG. 3F is a depiction of the cross-sectional arrangement of the mating surfaces of the ring structure and the mating collar structure when the unitary helmet component/pier/ring structure assembly is rotated from the "offset" position into a "locked" position. This rotation substantially aligns the upper intermediate horizontally extending component 307 of the mating collar component over the lower intermediate horizontally extending component 319 of the ring structure, thus locking the unitary helmet component/pier/ring structure assembly to the mating collar structure.

Figure 3G:
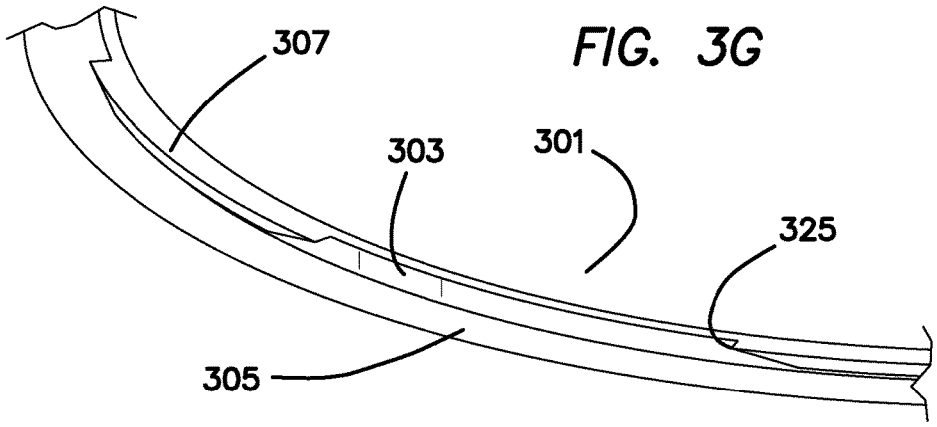
FIG. 3G shows a perspective top view of a portion of the mating surface of the mating collar structure of FIG. 2.

Referring now to FIG. 3G, a perspective top view of a portion of the mating surface of the mating collar structure (FIG. 2, 215) is shown, with upper intermediate horizontally extending components 307, upwardly vertically extending component 303 and bottom horizontally extending component 305. As shown in this figure, upper intermediate horizontally extending components 307 are spaced apart so as to fit the lower intermediate horizontally extending components 319 of the ring structure between them when the ring structure assembly is placed on the mating collar structure in an "offset" position.

As shown in FIG. 3G, preferably at least one of the upper intermediate horizontally extending component 307 and the lower intermediate horizontally extending component 319 is formed with one or more narrowed substantially wedge-shaped end 325 to facilitate the subduction of the lower intermediate horizontally extending component 319 under the upper intermediate horizontally extending component 307 when the ring structure of the helmet component is rotated into a locked position within the mating surface of the mating collar structure (FIG. 2, 215). Additionally, the width of the upper intermediate horizontally extending component 307 and/or the lower intermediate horizontally extending component 319, at, for example, a transverse midpoint 323, should be sufficiently wide to wedge and maintain the lower intermediate horizontally extending component 319 in a locked position under the upper intermediate horizontally extending component 307, and prevent it from slipping past the widest part of the upper intermediate horizontally extending component 307, thus becoming "unlocked".

Those of ordinary skill in the art will recognize that the widest point of the upper and/or lower intermediate horizontally extending components may be located at positions other than midway along the transverse length of the component. For example, one or both of these components may be formed as a wedge or partial wedge, having the widest part of the wedge located at one end thereof. Furthermore, while this description provides one example of a locking mechanism for joining the helmet component to the shoulder pad component, those of ordinary skill in the art will immediately envision alternative methods.

Figure 4:
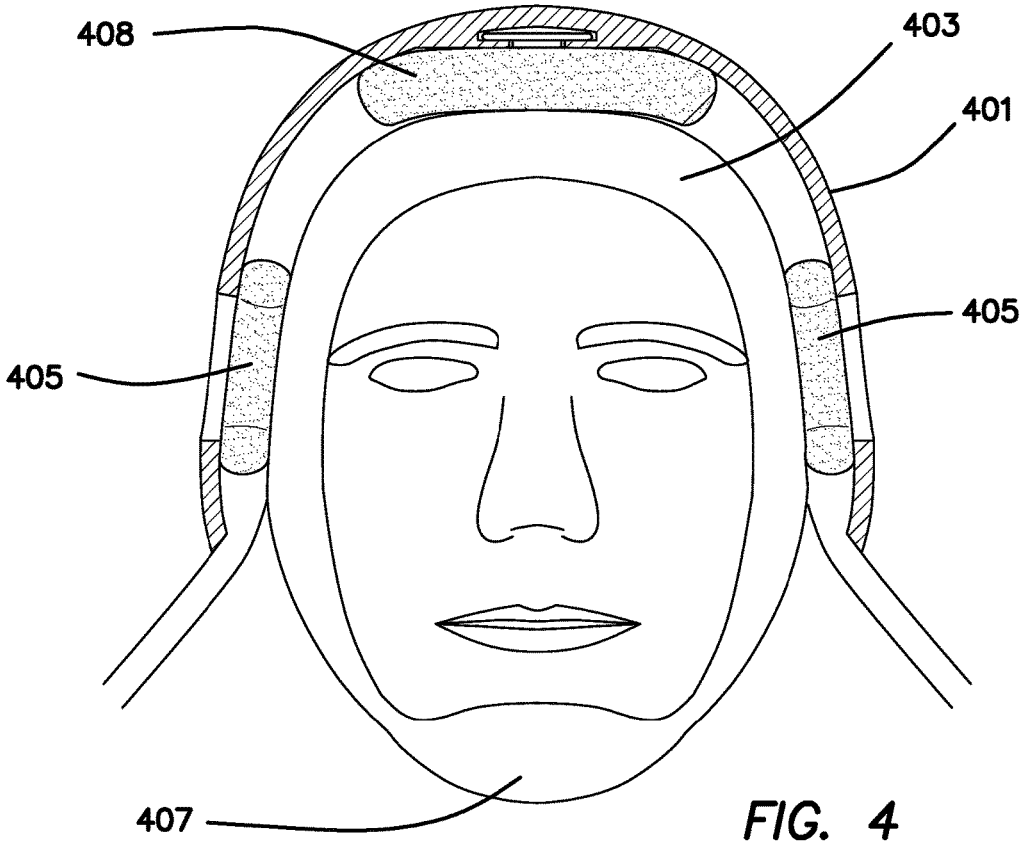
FIG. 4 shows a partial cutaway front view of a helmet component and inner hat component of the present invention.

FIG. 4 shows a partial cutaway view of an example of a helmet component 401 being worn by a player together with an inner hat component 403. In the example shown, the helmet component 401 (shown for clarity without the face mask) comprises a top fluid-filled floating plate 408 on the inside surface of the helmet, and two side fluid-filled floating plates 405 located proximate to the temple area of the wearer's head. The inner hat closely fits the wearer's head, and is preferably not attached to the inside of the helmet component. The inner hat component preferably comprises a padded chin strap 407 to secure the hat component to the head, and a face and forehead mask made of padding to protect against the face being forced towards the face mask (shown in FIG. 9 and FIG. 10)). The crown of the inner hat is preferably free to move within the inside surfaces of the helmet component, (except, in certain examples, the inner hat makes contact against the top float) so that the wearer can move the head and inner hat from side to side and/or up and down relatively freely within the helmet.

Figure 5:
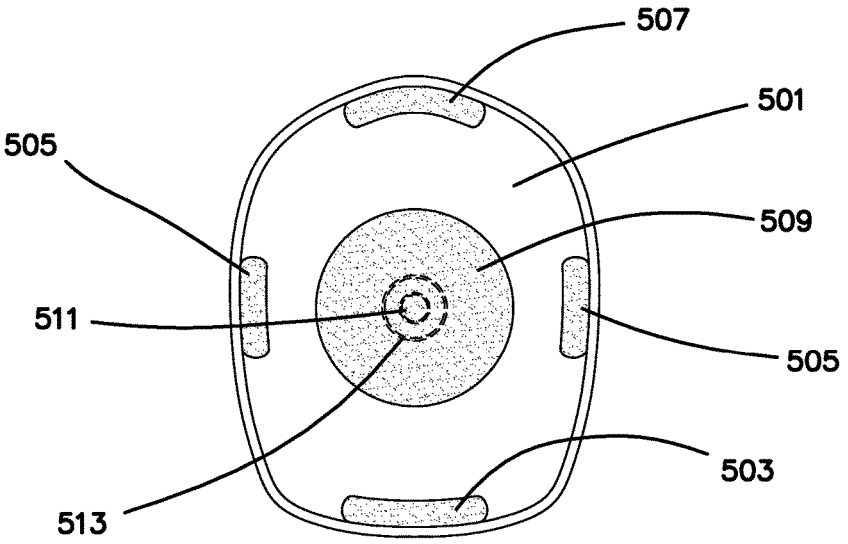
FIG. 5 shows a view of the inner surface of a helmet component of the present invention.

FIG. 5 shows a upward view of the inside surface 501 of an exemplary helmet component in accordance with the apparatus of the present invention. In this view, the top fluid-filled float 509 is secured to the interior surface of the helmet by a sliding spindle component 511 set into a circular inset 513 formed within the helmet components inside surface. A forehead float 503, two side floats 505, and a rear float 507 are also shown. The sliding spindle arrangement thus may function like a "lazy susan" permitting rotation of the head within the helmet component. For clarity, in this view the piers are not shown.

Figure 6:
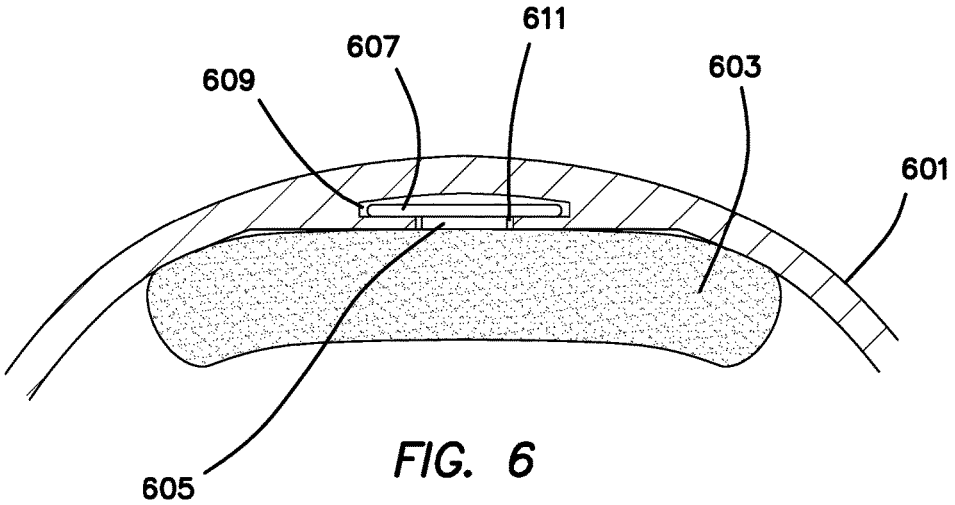
FIG. 6 shows a view of a spindle component and top float assembly of the helmet component of FIG. 5.

FIG. 6 is a cross section of the portion of the helmet component of FIG. 5 showing the top float 603 and the spindle component 605, which fits within a void 609 formed within the inner surface of the helmet component and is secured in place by a circular insert 607. The spindle component 605 must be strong and preferably has a diameter equal to or less than about half that of the hole 611 in the inner surface of the helmet component through which the spindle component projects to permit the spindle component 605 to slide freely from one side of the hole 611 to another. The circular inset 607 preferably has a diameter sufficiently greater than hole 611 to permit the top float 603 to rotate around the axis of the spindle component 605.

In this manner, during use the wearer will have the benefit of the protection of the protective headgear apparatus (the elements of which, form the unitary engineered network), while the inner hat and float assembly and the space within the helmet assembly will allow the wearer to move the head relatively freely within the helmet component in order to be able to scan the playing field and/or outside environment without requiring the shoulders or body to move.

Figure 7:
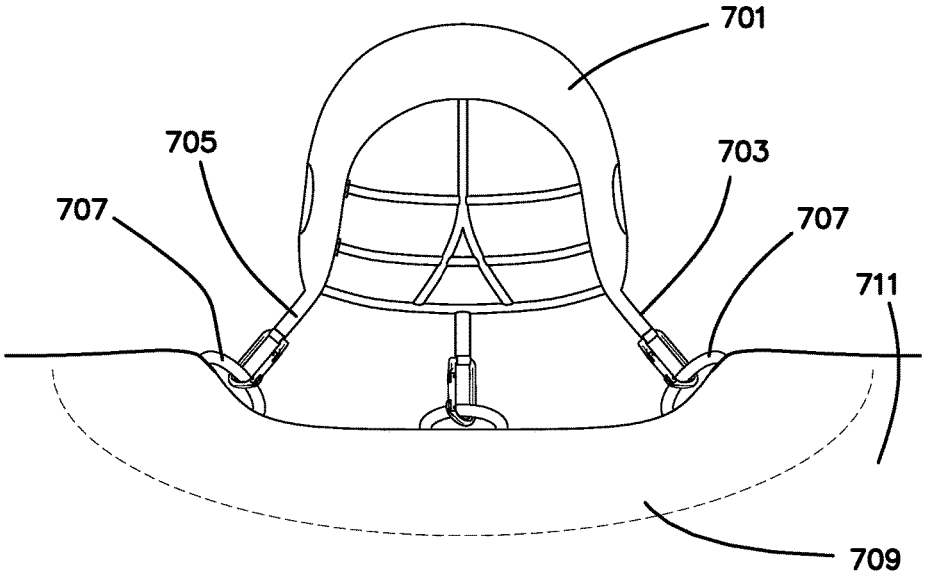
FIG. 7 shows a frontal view of one example of a helmet component/shoulder pad component assembly of the present invention.

FIG. 7 shows another example of the protective headgear apparatus of the present invention. The helmet component 701 and piers 703 in this example are configured essentially as shown in FIG. 1A and FIG. 1B, with the lower end of each pier comprising a connector component 705 comprising a hook latch structured to fit within a connector receptacle component (loop) 707 firmly incorporated as part of an ovoid force-diffusing element 709 incorporated as part of the shoulder pad component. The force-diffusing element is, joined to, or comprises part of, the shoulder pad component 711 (the entire shoulder pad component including the shoulder joint coverings, is not shown in this view). In other words, the force-diffusing element 709 receives force from a blow or shock to the helmet component 701 through the piers 703 and distributes the force of the blow or shock through the force-directing members (FIG. 13A and FIG. 13B) of the shoulder pad component 711, thus lessening the severity of this force at any one point, and distributing the force through the shoulders, chest, and musculature of the back.

The force-diffusing element may preferably be fabricated as part of the shoulder pad component, with connector receptacle components built therein. Less preferably, but still within the scope of this invention, the force-diffusing element may be fabricated as a separate element to be secured to an existing shoulder for example, with nylon webbing and buckles, or anther similar suitably strong connector. IN either case the shoulder pad component very preferably comprises a plurality of force-directing members that distributes the force of the transmitted blow through the shoulders, chest, and musculature of the back.

Figure 8:
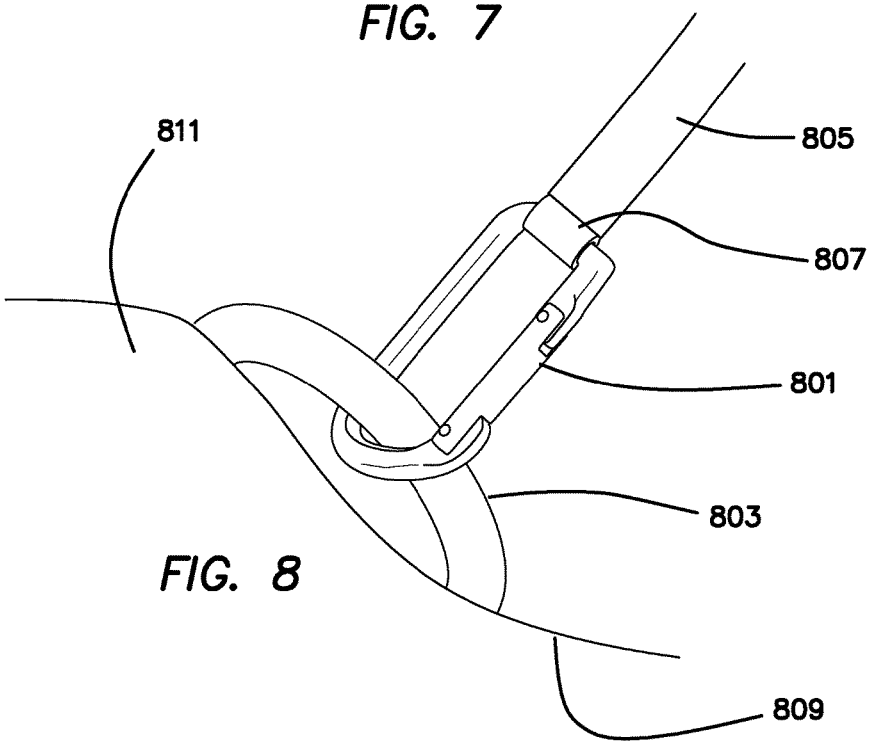
FIG. 8 shows a close up view of the pier connectors and mating connector elements shown in FIG. 7.

Turning now to FIG. 8, this provides a close up view of the pier connectors 801 and mating connector structure 803 of the protective headwear assembly shown in FIG. 7. In this case, the piers 805 terminate in a reinforced eyelet 807 comprising a hole through which the pier connector 801 (here shown as a hook snap) may be introduced. The mating connector structure 803 shown in FIG. 8 is a reinforced loop comprising a stainless steel cable core encased within a durable, slightly flexible hard polymer. The mating connector structure 803 is located around the edge 809 of an ovoid force-diffusing element 811, with which it is integrated and either connected or proximal to the force-directing members of the shoulder ad component so as to permit the force to dissipate over the shoulders, back and chest of the user. The force-diffusing element 811 is a part of the shoulder pad component.

Figure 9:
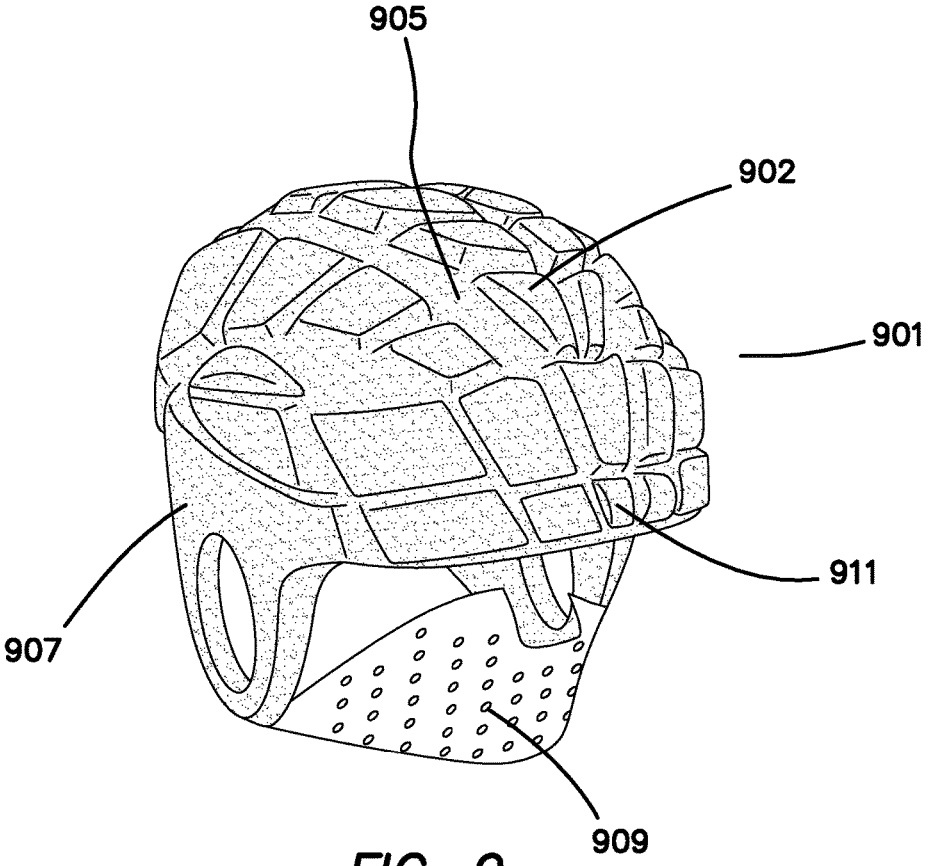
FIG. 9 shows an example of an inner hat of the present invention.

FIG. 9 is a depiction of an inner hat of the present invention. The inner hat 901 may be comprised of polymeric material, particularly, around the head the polymeric material is cushioning or padding material. The inner hat is preferably lightweight. The polymeric padding may underlie a skin comprising a smooth, low friction material such as a TEFLON® lubricant surface 905. In FIG. 9, the padding 902 is shown underlying the TEFLON® skin. The inner hat has ear protection 907, forehead padding 911, and a padded mask 909 covering the mouth and nose, and serving as a chin strap to secure the inner hat to the wearer's head. In some examples the outer surface of the inner hat may be untextured and substantially smooth.

FIG. 10 shows a portion of the shoulder pad component 1001 comprising a collar component 1003 encircling the neck of the wearer for the prevention of whiplash and head injury due to the movement of the head inside the fixed helmet 1007 following an impact. The piers 1005 supporting the helmet are also shown. Importantly, the collar component comprises a unitary engineered network firmly integrated into or affixed to the shoulder pad assembly by force directing members contained therewithin, as described above. The collar component preferably comprises a padded surface near the skin (such as neoprene or another foam polymer), and a strong, comparatively thin, flexible protective material such as a metal, polymeric, carbon fiber, or fiberglass material surrounding the neck. The interior of the collar component may curve outward convexly to support the neck and cushion the head, while not substantially interfering with head or shoulder movement.

FIG. 11 is the apparatus of FIG. 10 with the helmet component removed to show the integrated or attached collar component (with its padding or cushioning overlying the strong resilient material underneath) more clearly.

Figure 12:
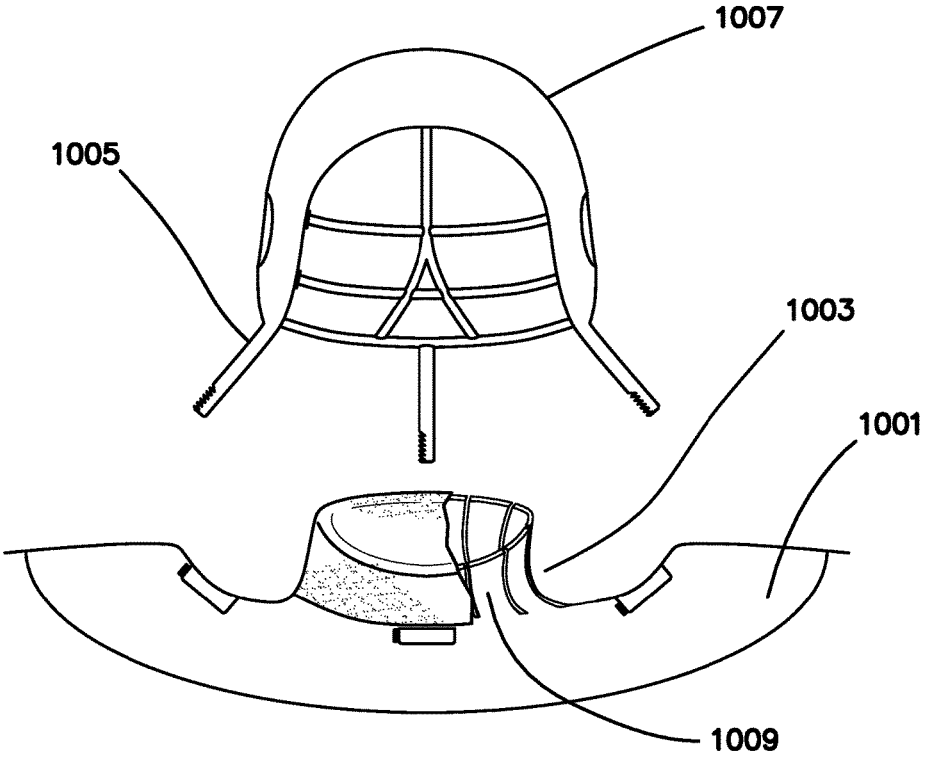
FIG. 12 shows an alternative design of a collar component comprising a series of staves.

FIG. 12 shows an alternative design of a collar component 1003. In this design, the collar component comprises a series of stave components 1009 arranged around the neck opening of the shoulder pad component 1001. The stave components may each comprise a strong, comparatively thin, flexible material such as a metal, carbon fiber, or fiberglass, and may have a width of from about ½ inch to about 3 inches or so, in half-inch intervals. The staves may be collectively and/or individually covered with a padding or cushioning material, particularly where the collar component contacts the neck. Individual staves made be formed to curve outward convexly (when viewed from the perspective of the shoulder pad neck opening) in order to support the neck, while being sufficiently wide at the top and bottom not to substantially interfering with head or shoulder movement. The staves are firmly integrated into or affixed to the shoulder pad assembly. For example, without limitation, the bottom portions of the staves may be linked together by one or more fiber, cable, wire, or bundle comprising an integral part of the shoulder pad assembly, or may be molded as part of a shoulder pad component.

It will be understood that in some examples of the present invention, a shoulder pad assembly. Unless specifically excluded, a shoulder pad component include a plurality of force-directing members; and support for such specific exclusion is hereby provided.

Figure 13A:
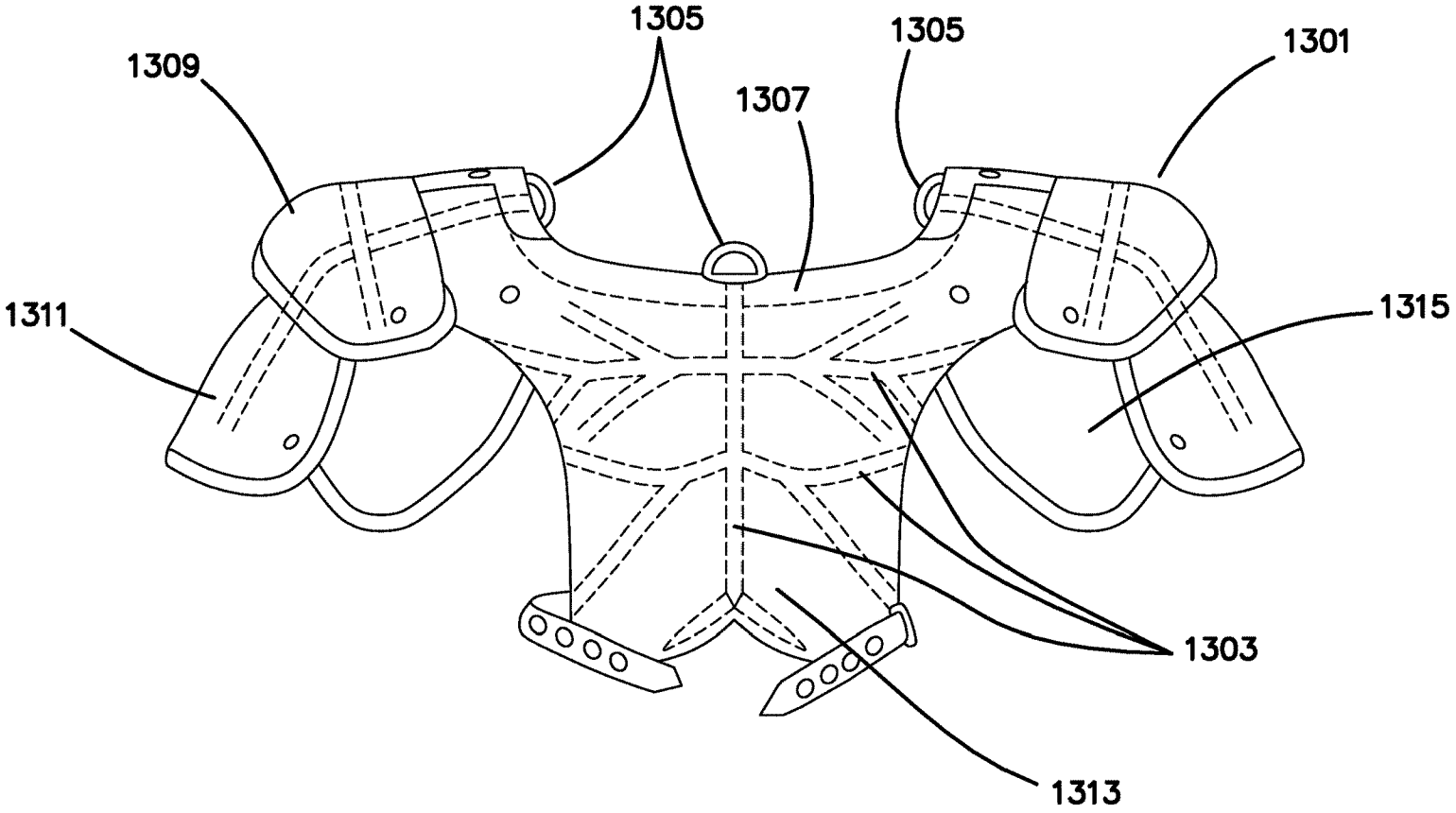
FIG. 13A shows a front view of an example of a shoulder pad component having force-directing members.

FIG. 13A is a front view of an example of a shoulder pad component 1301 of the present invention, showing an example of integral force-directing members 1303 embedded within the shoulder pad component and linking the connector receptacles 1305, which receive the piers of the helmet (not shown), with the force diffusing component 1307 integrated within the shoulder pad component. As described above, the shoulder pad component comprises a hard polymeric outer shell covering the shoulders including the shoulder joint, for example, comprising shoulder plates 1309, arm plates 1311 and body plates 1313. The polymeric outer shell overlies an inner layer of a polymeric foam 1315. The inner layer may in other examples be a fluid-filled padding. The shoulder pad component is shown with a belt or cinch to secure the shoulder pad apparatus around the waist.

As shown, the force-directing members 1303 are arranged in a manner similar to the roots of a tree, along the chest, back (not shown) and along the shoulders and upper arm so as to diffuse the force of a blow to the helmet transmitted through the piers and then throughout the shoulder pad apparatus to the shoulders and upper body and away from the head. The force-directing members are preferably transversely flexible, but linearly rigid enough to absorb and direct a force received from the helmet via a connecting receptacle inner hatto the shoulders and back in preference to the neck or spine. The force-directing members may comprise, without limitation, rigid but flexible natural, elastomeric, metallic, or synthetic fibers or materials (or a mixture of any of these), rods, or narrow flexible strips (battens) permanently or removably integrated as part of the shoulder pad component.

Figure 13B:
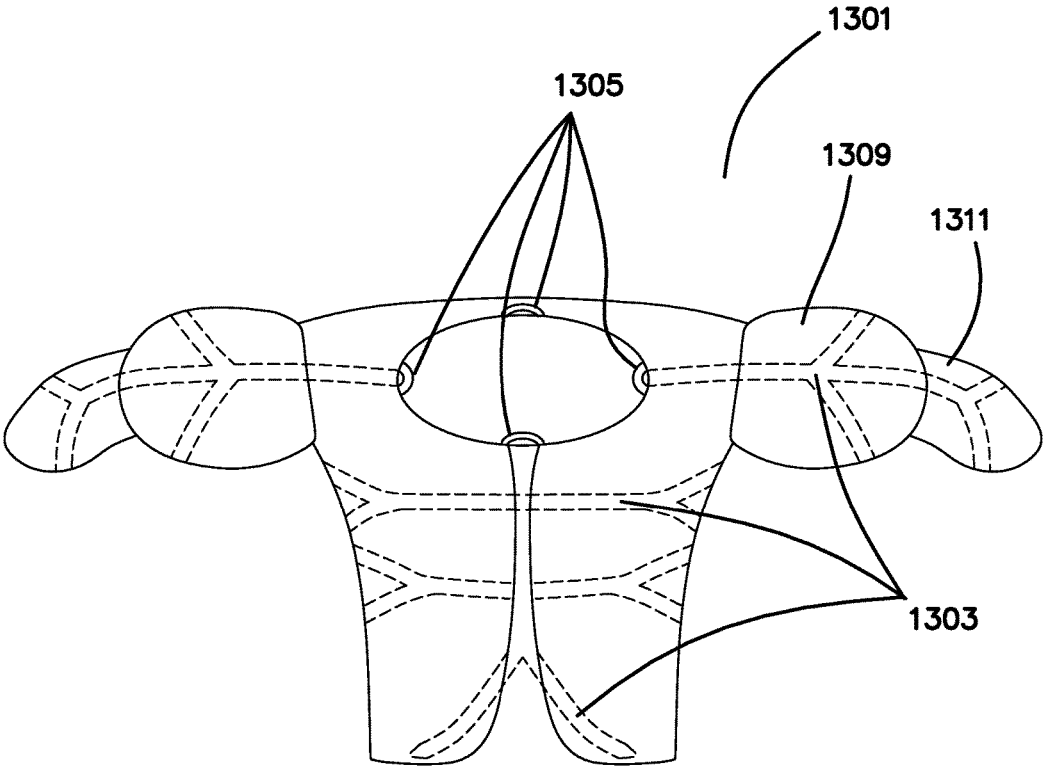
FIG. 13B shows an oblique top view of an example of a shoulder pad component having force-directing members.

FIG. 13B depicts the shoulder pad component of FIG. 13A in an elevated, back view, showing the force-directing members 1303 arranged along the top of the shoulder pad apparatus, and along the portion overlying the shoulders, including the shoulder joint, (see shoulder plates 1309 and arm plates 1311).

In the present invention, even in variants in which the shoulder pad component comprises a collar component, the pier connector receptacles are comprised below the neck level; that is, around the neck opening (i.e., supported by the clavicles, upper ribs, sternum and scapulae and overlying muscles), and never in the ring or collar surrounding the neck.

This distinction is critical to the present invention. Anchoring the piers in a collar around the user's neck, even if the collar is attached to a harness or shoulder pad, could easily lead to severe neck injury. For example, force from a horizontal, continuing blow to one side of the helmet could cause the helmet to accelerate and move in a horizontal direction substantially parallel to the collarbone, and could easily result in a neck fracture.

By contrast, in the present invention, the piers are anchored below neck level to the chest, shoulders and upper back (over the scapulae). By attaching the piers in this location, such a sliding horizontal blow is concentrated on the upper body rather than the neck, and the force is distributed over a larger surface than the neck and collarbone.

Figure 14:
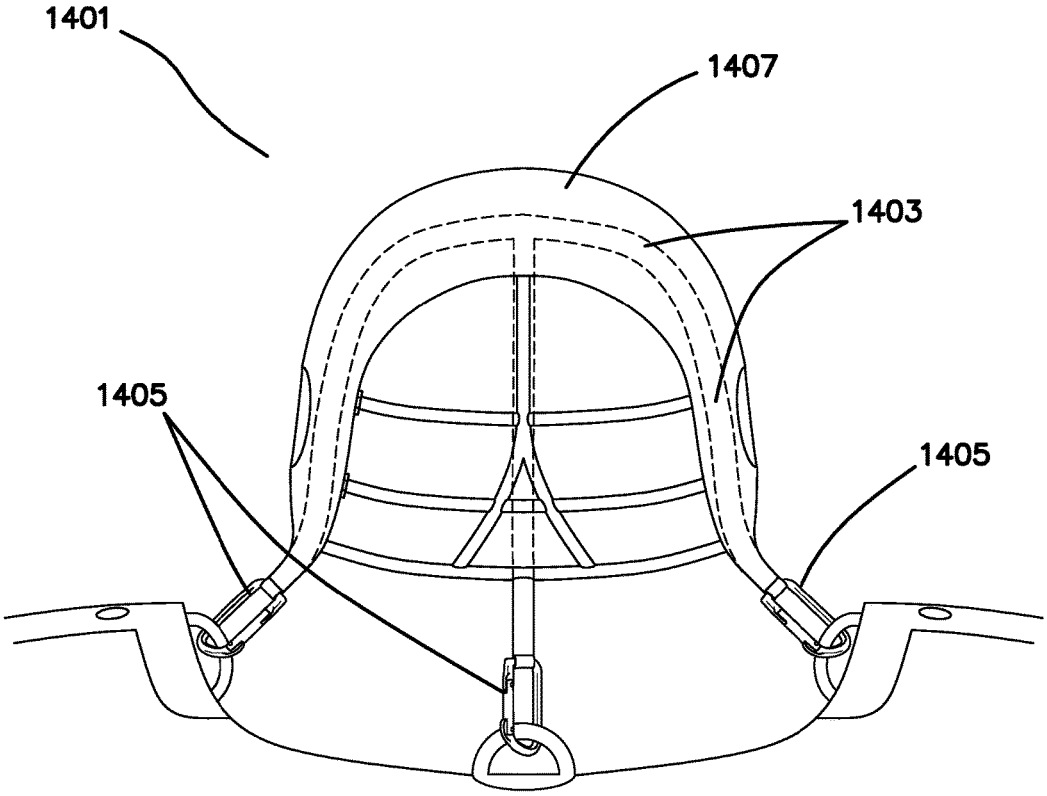
FIG. 14 shows a front view of a helmet component of the present invention showing the integration of the piers within the helmet.

FIG. 14 is a partial cutaway front view of a helmet component of the present invention 1401 comprising a plurality of piers 1405 integrated as part of the helmet component itself 1403, and joining at the crown of the helmet 1407. As an integral part of the helmet, the piers comprise a suitably strong and lightweight material, such as, without limitation, one or more of titanium, a titanium alloy, a non-titanium metal, a nanostructured ceramic, a nanostructured metal or metal alloy, a thermopolymer, or a carbon polymer. The plurality of piers are preferably connected to more effectively conduct and distribute the force from a blow to the helmet component among said plurality of piers.

To the extent that a plurality of inventions may be disclosed herein, any such invention shall be understood to have disclosed herein alone, in combination with other features or inventions disclosed herein, or lacking any feature or features not explicitly disclosed as essential for that invention. For example, the inventions described in this specification can be practiced within elements of, or in combination with, other any features, elements, methods or structures described herein. Additionally, features illustrated herein as being present in a particular example are intended, in other examples of the present invention, to be explicitly lacking from the invention, or combinable with features described elsewhere in this patent application, in a manner not otherwise illustrated in this patent application or present in that particular example. The scope of the invention shall be determined solely by the language of the claims.

The present invention may, in certain examples, be drawn to a unitary helmet component/pier/shoulder pad component assembly, with and without the inner hat and with and without the force-diffusing element. In other examples, the invention may be drawn to the helmet component comprising integrated piers. In other examples, the invention may be drawn to the shoulder pad component comprising the force-diffusing element. In other examples, the invention may be drawn to the helmet component and inner hat. In other examples, the invention may be drawn to methods for protecting the head from experiencing the full impact of a blow thereto, using any, all, or any combination of the elements of the protective headgear described herein.

Thus, the various descriptions of the invention provided herein illustrate presently preferred examples of the invention; however, it will be understood that the invention is not limited to the examples provided, or to the specific configurations, shapes, and relation of elements unless the claims specifically indicate otherwise. Based upon the present disclosure a person of ordinary skill in the art will immediately conceive of other alternatives to the specific examples given, such that the present disclosure will be understood to provide a full written description of each of such alternatives as if each had been specifically described.

What is claimed is:

1. A protective headpiece, comprising:

a) a helmet component having an interior surface comprising a padding component, and an exterior surface comprising an impact-resistant polymer, b) a shoulder pad component structured to cover the shoulder blades of a wearer and comprising a hard plastic shell with foam padding underneath, said shoulder pad component further comprising a force-diffusing element integrated around a neck opening of the shoulder pad component, said force diffusing element having one or more connector receptacles as part thereof;

c) at least one force-directing member integrated as part, of at least one of the front, the back, and the top, of the shoulder pad component, said at least one force-directing member comprising a rigid but flexible material selected from the group consisting of: a natural material, an elastomeric material, a metallic material, a synthetic material, and a mixture of any of these;

d) a plurality of piers affixed to said helmet component and said shoulder pad component, and extending between each said helmet component and a plurality of connector receptacles of said shoulder pad component, said plurality of piers being integrated into and structurally connected within the helmet component as part of the helmet manufacturing process, and each pier of said plurality of piers having an end comprising a connector removably affixed to at least one of said one or more connector receptacles of the force diffusing element of said shoulder pad component, respectively, to form a unitary engineered network effective to selectively transfer impact forces from the helmet component through the plurality of piers, and the shoulder pad component to a wearer's shoulders and body in preference to a wearer's head, neck and spine;

wherein said helmet component has an interior surface adapted to permit a wearer to turn his or her head from side to side within the helmet component without the helmet component itself moving.

2. The protective headpiece of claim 1 further comprising a face mask component having one or more protective bars, said one or more bars having tensile strength sufficient to resist a blow having a force of at least 100 G without breaking.

3. The protective headpiece of claim 1 wherein each of said plurality of piers has a tensile strength sufficient to resist a blow having a force of at least 100 G without deforming.

4. The protective headpiece of claim 1, comprising:

e) an inner hat component structured to fit on a wearer's head within said helmet component, said inner hat comprising a chin strap and a fastener therefor on opposite sides of a lower anterior portion of said inner hat component adapted to fasten the inner hat component to the wearer's head, and a padding comprising a mask component and/or forehead component adapted to prevent injury to a forehead, mouth and/or nose during use;

said helmet component and said inner hat component each being structured to permit said wearer to move the head and the inner hat component independently from the helmet component during use.

5. The protective headpiece of claim 4, wherein the interior surface of the helmet component comprises at least one additional padding component structured to contact said inner hat component.

6. The protective headpiece of claim 5, wherein the padding component of the helmet component is substantially smooth.

7. The protective headpiece of claim 5, wherein said at least one padding component is adapted to contact said inner hat component at a location proximal to a crown of the wearer's head.

8. The protective headpiece of claim 7, comprising a plurality of padding components contacting said inner helmet component.

9. The protective headpiece of claim 5, wherein said at least one padding component adapted to contact said inner hat component at a location proximal to a crown of the wearer's head is structured to rotate about a substantially downward axis.

10. The protective headpiece of claim 5, wherein said at least one padding component is affixed to the interior surface of the helmet component.

11. The protective headpiece of claim 4, wherein at least one additional padding component is affixed to an outer surface of said inner hat component.

12. The protective headpiece of claim 4 wherein either or both the interior surface of the helmet component and the exterior surface of the inner hat component have a coating comprising polytetrafluoroethylene (PTFE).

13. The protective headpiece of claim 12 wherein at least one of the interior surface of the helmet component and the exterior surface of the inner hat component are substantially smooth.

14. The protective headpiece of claim 1, wherein said at least one padding component contains a fluid.

15. The protective headpiece of claim 1 wherein said one or more connector receptacle further comprises a shock-absorbing component damping downward forces applied to the shoulder pad component through the at least one of said plurality of piers.

16. The protective headpiece of claim 1 further comprising a face mask component, wherein said face mask component comprises at least one of said plurality of piers extending substantially downward therefrom, said at least one pier structured to fit within a locking connector receptacle component of said shoulder pad component.

17. The protective headpiece of claim 1 wherein at least one of said plurality of piers is positioned at or near each of: a posterior of the helmet component, a left side of the helmet component, a right side of the helmet component, and an anterior portion of the helmet component, respectively; and wherein each of said piers comprises a connector component structured to fit a respective connector receptacle component of said shoulder pad component, each said one connector receptacle component structured to releasably hold said at least one of said plurality of piers.

18. The protective headpiece of claim 1 wherein said connector is selected from the group consisting of hook latch, a ring, a barbed pier connector.

19. A method for protecting a player's head from concussion during a contact sport comprising:

placing a shoulder pad component on said player's upper body, said shoulder pad component structured to cover the shoulder blades of the player and comprising a hard plastic shell with foam padding underneath, said shoulder pad component further comprising a force-diffusing element integrated around a neck opening of the shoulder pad component, said force diffusing element having one or more connector receptacles as part thereof;

placing a helmet component on said player's head, said helmet component having an interior surface comprising a padding component, an exterior surface comprising an impact-resistant polymer, and a plurality of piers being integrated into and structurally connected within the helmet component as part of the helmet manufacturing process, each pier of said plurality of piers having an end comprising a connector removably affixable to a connector receptacle of the force diffusing element of said shoulder pad component, respectively, to form a unitary engineered network effective to selectively transfer impact forces from the helmet component through the plurality of piers, and the shoulder pad component to the player's shoulders and body in preference to the player's head, neck and spine, and wherein the interior surface of said helmet component is adapted to permit the player to turn his or her head from side to side within the helmet component without the helmet component itself moving; and affixing said pier connectors to the corresponding connector receptacles of the shoulder pad component.

20. The method of claim 19 further comprising placing an inner hat component on the player's head prior to placing a helmet component on said player's head.

* * * * *